US005548493A

United States Patent [19]

Young

[11] Patent Number: 5,548,493

[45] Date of Patent: Aug. 20, 1996

[54] PHOSPHORESCENT LIGHT COLLARS

[76] Inventor: Anthony R. Young, 5717 Newcut Rd., Louisville, Ky. 40214-5605

[21] Appl. No.: 337,964

[22] Filed: Nov. 14, 1994

Related U.S. Application Data

[63] Continuation of Ser. No. 19,463, Feb. 18, 1993, abandoned.

[51] Int. Cl.[6] ..... F21V 9/16

[52] U.S. Cl. ..... 362/84; 362/226; 362/242; 362/255; 362/260; 362/806; 250/462.1; 428/7

[58] Field of Search ..... 428/7, 690; 362/34, 362/84, 122, 123, 189, 226, 228, 230, 231, 241, 249, 255, 256, 260, 806, 242; 250/462.1, 464.1

[56] References Cited

U.S. PATENT DOCUMENTS

| | | | |
|---|---|---|---|
| 1,150,118 | 8/1915 | Hewitt | 362/84 |
| 1,313,622 | 8/1919 | Dodds | 362/84 |
| 1,377,221 | 5/1921 | Popper | 362/806 |
| 1,395,110 | 10/1921 | Hole | 362/34 |
| 2,905,863 | 9/1959 | Martin et al. | 362/84 |
| 3,153,773 | 10/1964 | Wood | 362/84 |
| 3,791,058 | 2/1974 | Mollica | 362/84 |
| 3,967,274 | 6/1976 | Howell | 362/84 |
| 4,213,115 | 7/1980 | Wetzel | 362/84 |
| 4,215,390 | 7/1980 | Brandt | 362/363 |
| 4,528,621 | 7/1985 | Hoyt | 362/84 |
| 4,747,026 | 5/1988 | Rousseau | 362/189 |
| 4,999,544 | 3/1991 | Cibor | 362/806 |

*Primary Examiner*—Denise L. Gromada
*Assistant Examiner*—Alan B. Cariaso
*Attorney, Agent, or Firm*—Wood, Herron & Evans

[57] ABSTRACT

The present invention is collar for an ornamental light bulb in which the collar contains a phosphorescent material such that the light bulb emits light into the collar and stimulates the phosphorescent material within the collar to emit light. In a preferred embodiment of the present invention, the phosphorescent material is combined with a florescent dye to produce a miniature light collar containing a phosphorescent-florescent dye. Preferably, the collar is comprised of a low density polyethylene to promote flexibility of the collar to enable to fit over miniature bulbs of varying sizes. The present invention is further comprised of a plastic collar for a miniature light comprised of a cylinder having a series of slots cut into the cylinder such that the cylinder can expand to accommodate light bulbs of varying sizes.

8 Claims, 1 Drawing Sheet

PHOSPHORESCENT LIGHT COLLARS

This application is a continuation of application Ser. No. 08/019,463, filed Feb. 18, 1993 now abandoned.

FIELD OF THE INVENTION

The present invention lies in the field of ornamental lights and in particular miniature lights such as Christmas Tree lights.

BACKGROUND OF THE INVENTION

Miniature lights such as Christmas tree lights very often have collars which can be used both as decorative and supporting elements. However, these collars do not have the ability to emit light themselves.

SUMMARY OF THE INVENTION

The present invention is collar for an ornamental light bulb in which the collar contains a phosphorescent material such that the light bulb emits light into the collar and stimulates the phosphorescent material within the collar to emit light.

In a preferred embodiment of the present invention, the phosphorescent material is combined with a florescent dye to produce a miniature light collar containing a phosphorescent-florescent dye. Preferably, the collar is comprised of a low density polyethylene to promote flexibility of the collar to enable to fit over miniature bulbs of varying sizes.

The present invention is further comprised of a plastic collar for a miniature light comprised of a cylinder having a series of slots cut into the cylinder such that the cylinder can expand to accommodate light bulbs of varying sizes.

DETAILED DESCRIPTION OF THE INVENTION

The present invention is a plastic collar for a miniature light comprised of a plastic/phosphorescence composite, along with a collar design which captures light from a miniature light, and emits the light as a halo after the light has been extinguished.

The preferred embodiment of the collar of the present invention is designed to snap on and fit all miniature light bulbs. This was done by making the collar from a flexible plastic capable of expanding and contracting to accommodate bulbs of varying sizes. An example of such a plastic is a linear low density polyethylene such as DOWLEX® (Dow Chemical Co. Midland, Mich.) This results in a constant pressure on the light bulb and maintains a positive lock on the bulb.

Figure 1:
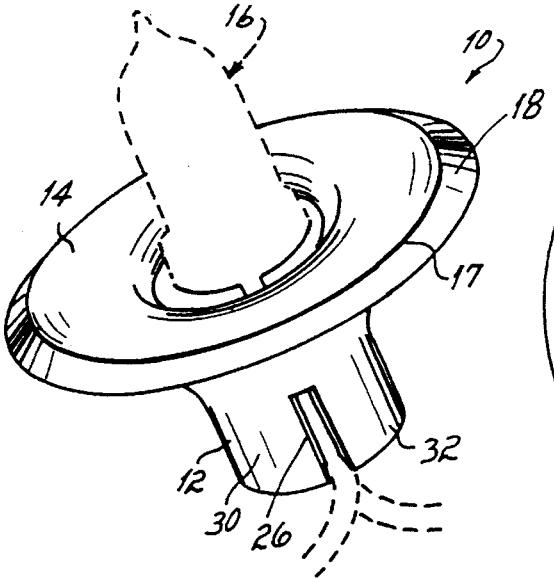
FIG. 1 shows a perspective view of a preferred collar of the present invention.
Figure 2:
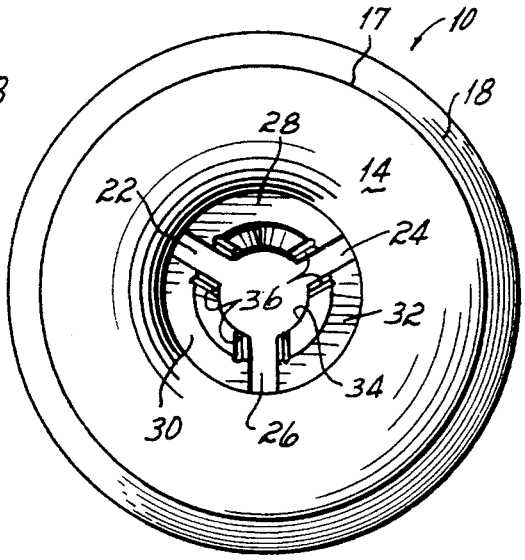
FIG. 2 shows a top view of a preferred collar of the present invention.
Figure 3:
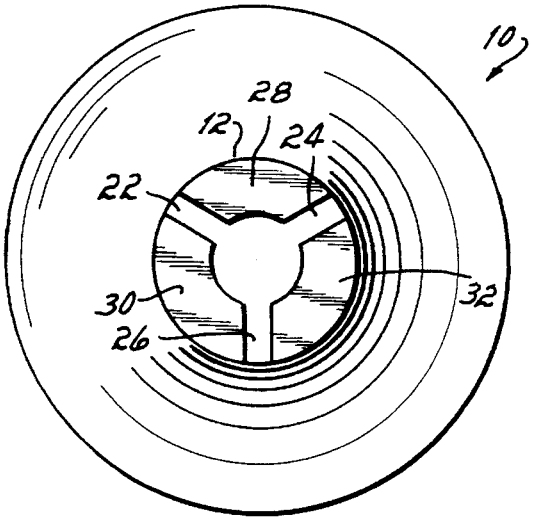
FIG. 3 shows a bottom view of a preferred collar of the present invention.
Figure 4:
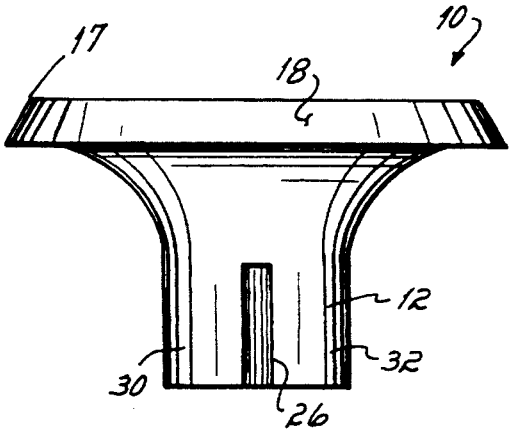
FIG. 4 shows a side view of a preferred collar of the present invention.
Figure 5:
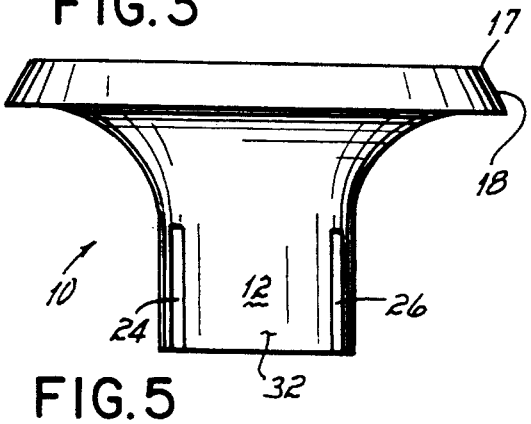
FIG. 5 shows another side view of a preferred collar of the present invention in which the collar was rotated 90° relative to FIG. 4.
Figure 6:
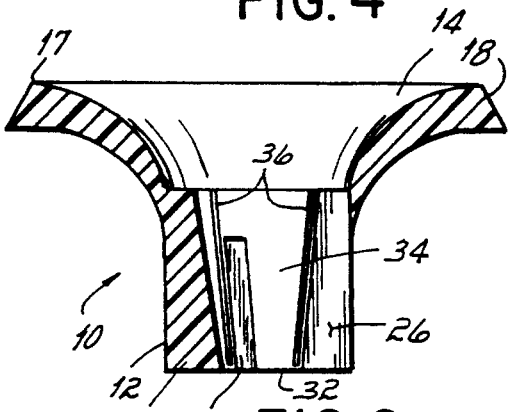
FIG. 6 shows a cut-away view of a collar of the present invention.

The design of the preferred embodiment of the collar is shown in FIGS. 1–6. Collar 10, FIG. 1 is comprised of a bottom cylindrical sleeve 12 and a flared top 14. A light bulb 16 is placed through the bottom of cylindrical sleeve 12 and protrudes above top 14. Outer most edge 17 of top 14 is cut to produce tapered rim 18 which is designed to transfer light when a light is inserted and turned on. This creates in conjunction with phosphorescence in the collar a "halo effect". Rim 18 is cut in such a way to be visible in a 180° path of optically radiated light. There are three slots 22, 24, and 26 (FIGS. 4 and 5) cut into cylindrical sleeve 12. This allows for greater flexibility of cylindrical sleeve 12. Slots 22, 24, and 26 divide sleeve 12 into three sections 28, 30, and 32. The inner surfaces of sections 28, 30, and 32 have longitudinal grooves to more securely hold a bulb. This is better seen in FIG. 6 which has sleeve 12 cut away to expose inner surface 34 of sleeve section 32. A groove 36 is formed in surface 34.

In a preferred embodiment of the present invention, a phosphorescent dye or pigment is present on or within the collar. Preferably the phosphorescent dye is incorporated into the dye during manufacture of the collar. However, the phosphorescence can be placed on the collar by other mean such as by the application of phosphorescent paint onto the collar.

The following examples are included to illustrate the present invention but not to limit the claims.

EXAMPLE 1

Pink Florescent-Phosphorescent Collar

Twenty pounds of #2535 DOWLEX® liner low density polyethylene pellets (Dow Chemical Co., Midland, Mich.) were mixed with one teaspoonful of mineral oil so that the oil was evenly dispersed over the pellets.

A phosphorescent pigment mixture was produced by mixing 426 grams of phosphorescent standard yellow (G-41676/DC, Chroma Corp. McHenry, Ill.) and 438 grams of Phosphorescent Bright Pink (G-35070/DC, Chroma, Corp., McHenry, Ill.). The resultant phosphorescent pigment mixture was then added to the polyethylene/mineral oil mixture. The resultant mixture was thoroughly mixed together in the hopper of an injection mold machine; preheated to 410° F.; and injected into an aluminum mold within the machine. The machine had a cycle of 20 seconds after which the resultant pink-phosphorescent collar was allowed to cool at ambient temperatures.

EXAMPLE 2

Green Florescent-Phosphorescent Collar

A green florescent collar was produced according to the procedure of Example 1 except the pigment mixture was comprised of 284 grams of phosphorescent standard yellow (G-41676/DC, Chroma Corp. McHenry, Ill.) and 600 grams of Phosphorescent Bright Green (G-62052/DC, Chroma Corp., McHenry, Ill.).

EXAMPLE 3

Blue Florescent-Phosphorescent Collar

A blue florescent collar was produced according to the procedure of Example 1 except the pigment mixture was comprised of 710 grams of phosphorescent standard yellow (G-41676/DC, Chroma Corp. McHenry, Ill.) and 162 grams of Phosphorescent Bright Blue (G-53883/DC, Chroma Corp., McHenry, Ill.).

EXAMPLE 4

Yellow Florescent-Phosphorescent Collar

A yellow florescent collar was produced according to the procedure of Example 1 except the pigment mixture was comprised of 568 grams of phosphorescent standard yellow (G-41676/DC, Chroma Corp. McHenry, Ill.) and 292 grams of Phosphorescent Bright Yellow (G-41675/DC, Chroma Corp., McHenry, Ill.).

EXAMPLE 5

Natural Yellow-Phosphorescent Collar

A natural collar was produced according to the procedure of Example 1 except the pigment mixture was comprised of 852 grams of phosphorescent standard yellow (G-41676/DC, Chroma Corp. McHenry, Ill.).

What is claimed is:

1. Ornamental Christmas tree lights wherein said lights each include a light bulb held in a fixture and a collar surrounding said light bulb, said collar having a hollow, cylindrical portion opened at a first end and a second end permitting said light bulb to fit within said first end;

an outwardly extended annular flared portion at said second end, said light bulb extended through said first end and at least partially beyond said second end, and wherein said collar comprises a fluorescent-phosphorescent material;

whereby a portion of light emitted from said light bulb causes said collar to fluoresce.

2. The combination claimed in claim 1 wherein said collar comprises a flexible polymer in combination with a fluorescent phosphorescent material.

3. The combination claimed in claim 1 wherein said flared portion includes an annular, peripheral tapered rim whereby fluorescent light emitted from said collar emanates from said rim to create a halo effect.

4. The combination claimed in claim 1 wherein said cylinder includes at least one slot dividing said cylinder into a plurality of arcuate tabs adapted to flex and engage said light bulb.

5. An ornamental light collar as recited in claim 1 wherein the fluorescent-phosphorescent material is incorporated into said collar during the manufacture of said collar.

6. An ornamental light collar as recited in claim 5 wherein a fluorescent-phosphorescent material is contained on or within said collar.

7. Ornamental Christmas tree lights wherein said lights each include a light bulb held in a fixture and a collar surrounding said light bulb, said collar having a hollow, cylindrical portion opened at a first end and a second end permitting said light bulb to fit within said first end;

an outwardly extended annular flared portion at said second end, said flared portion having a top surface and a bottom surface wherein both of said top surface and said bottom surface are exposed, said light bulb extended through said first end and at least partially beyond said second end, and wherein said collar comprises a fluorescent phosphorescent material;

whereby a portion of light emitted from said light bulb causes said collar to fluoresce.

8. Ornamental Christmas tree lights wherein said lights each include a light bulb held in a fixture and a collar surrounding said light bulb, said collar having a hollow, cylindrical portion opened at a first end and a second end permitting said light bulb to fit within said first end;

an outwardly extended annular flared portion at said second end, said light bulb extended through said first end and at least partially beyond said second end, and wherein said collar comprises a phosphorescent material;

whereby a portion of light emitted from said light bulb causes said collar to fluoresce.

* * * * *